US006902488B2

(12) United States Patent
Hashimoto et al.

(10) Patent No.: US 6,902,488 B2
(45) Date of Patent: Jun. 7, 2005

(54) LATERAL STEADY ACCELERATION SIMULATION SYSTEM FOR RAILWAY VEHICLE

(75) Inventors: Atsushi Hashimoto, Nagoya (JP); Hitoshi Okabe, Nagoya (JP); Eiichi Morimoto, Nagoya (JP)

(73) Assignee: Central Japan Railway Company, Nagoya (JP)

( * ) Notice: Subject to any disclaimer, the term of this patent is extended or adjusted under 35 U.S.C. 154(b) by 26 days.

(21) Appl. No.: 10/312,661

(22) PCT Filed: Jun. 25, 2001

(86) PCT No.: PCT/JP01/05429

§ 371 (c)(1),
(2), (4) Date: Dec. 27, 2002

(87) PCT Pub. No.: WO02/03360

PCT Pub. Date: Jan. 10, 2002

(65) Prior Publication Data

US 2005/0014566 A1 Jan. 20, 2005

(30) Foreign Application Priority Data

Jun. 30, 2000 (JP) ..... 2000-198755

(51) Int. Cl.[7] ..... A63G 31/16
(52) U.S. Cl. ..... 472/59; 472/130; 434/55
(58) Field of Search ..... 472/59, 60, 61, 472/62, 130; 434/29, 55, 62–71

(56) References Cited

U.S. PATENT DOCUMENTS 5,564,985 A * 10/1996 Engstrand ..... 472/60
5,707,237 A 1/1998 Takemoto et al. ..... 434/69
5,947,740 A * 9/1999 Kim ..... 434/29
6,152,828 A * 11/2000 Tomita et al. ..... 472/60
6,431,872 B1 * 8/2002 Shiraishi et al. ..... 434/69
6,592,374 B1 * 7/2003 Kim ..... 434/58

FOREIGN PATENT DOCUMENTS

JP 03-136086 6/1991 ..... G09B/9/04
WO 94/24652 A1 10/1994 ..... G09B/9/05

OTHER PUBLICATIONS

Suzuki, Hiroaki, Koji Omino and Naoki Fukushima, "Improvement in Performance of Riding Comfort Simulator", *Ergonomics*, vol. 33, No. 2, 1997, pp. 113–116.
*The Journal of the Robotic Society of Japan*, vol. 10, No. 7; Japan: The Robotic Society of Japan on Nov. 15, 1992 accompanied by 3 pages of appropriate translation.

* cited by examiner

*Primary Examiner*—Kien Nguyen
(74) *Attorney, Agent, or Firm*—Davis & Bujold, P.L.L.C.

(57) ABSTRACT

To provide a lateral steady acceleration simulation system for railway vehicle, which is capable of simulating a situation in which lateral steady acceleration is applied to a railway vehicle for a long period of time, while having a compact structure. In a riding quality simulation system of the invention, a control unit activates each of actuators (40), thereby making a simulated passenger room (10) roll. Then, the simulated passenger room (10) is gradually inclined, while a component force, along an inclined plane, of gravitational acceleration g, that is, a first reproductive acceleration G1 is generated depending on an angle of inclination θ. In this manner, a person riding on the simulated passenger room (10) bodily senses the first reproductive acceleration G1 by the roll. At the same time, the control unit moves the simulated passenger room 10, by means of a laterally moving device, in either of the left or right direction with acceleration G. In this manner, the person riding on the simulated passenger room (10) bodily senses a second reproductive acceleration G2. As a result, the person riding on the simulated passenger room (10) bodily senses a combination of the first and second reproductive accelerations G1 and G2 as lateral steady acceleration on a railway.

7 Claims, 6 Drawing Sheets

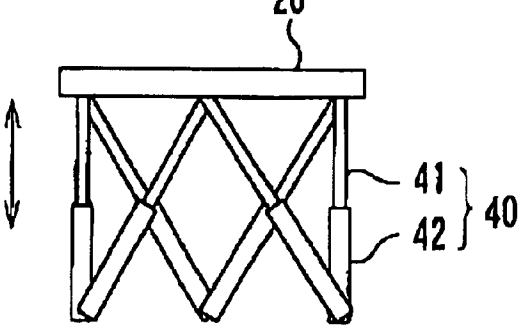
FIG. 3A NEUTRAL
FIG. 3B UP-DOWN
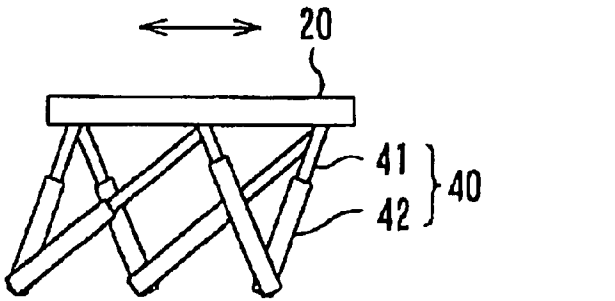
FIG. 3C LEFT-RIGHT, FORWARD-BACKWARD
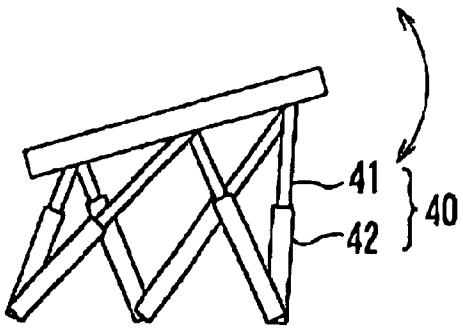
FIG. 3D ROLLING
PITCHING
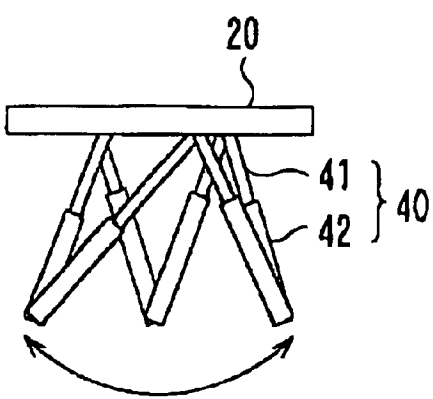
FIG. 3E YAWING

LATERAL STEADY ACCELERATION SIMULATION SYSTEM FOR RAILWAY VEHICLE

TECHNICAL FIELD

The present invention relates to a lateral steady acceleration simulation system for simulating lateral steady acceleration generated when a railway vehicle runs around a curve or the like.

BACKGROUND ART

In order to improve the riding quality of a railway vehicle, it is essential to accurately evaluate vibration and acceleration, which variously change depending on conditions of railroad tracks and vehicles, from the viewpoint of passengers. Such evaluation could be made by carrying out a running test, by means of an experimental vehicle, between runs by commercial vehicles. In this case, however, some problems arise as follows.

First of all, it is not easy to equalize the conditions of vehicles and tracks all the time running tests are performed, and reproducibility is not good. This fact results in a low reliability of evaluation. Also, it is difficult economically, and in view of efficiency as well, to shorten an interval of running tests or to carry out running tests a number of times. This fact results in a long period of development. Furthermore, it is not easy to modify conditions such as performance, properties, and the like.

On the other hand, there is known a system for simulating the riding quality without relying upon such running tests by use of experimental vehicles; that is, a simulation system by means of a simple four-axis vibration table for generating vibration along an up-down axis, a left-right axis, a forward-backward axis, and a roll axis (i.e., rotary motion about the forward-backward axis) (for example, refer to p.p. 113 to 116 of *Ergonomics*, vol. 33, 1997) This simulation system is capable of simultaneously generating vibrations along a plurality of axes arbitrarily selected among the four axes. According to such a simulation system, the aforementioned problems with the running of the experimental vehicles could be resolved.

However, no system for simulating lateral steady acceleration, which is generated when a railway vehicle runs around a curve, has yet been known.

Such a lateral steady acceleration simulation system could be realized by utilizing acceleration generated by moving a simulated passenger room in the left or right direction. In the case of a long-distance curve, however, a railway vehicle is subjected to the lateral steady acceleration for a long period of time. In order to simulate such a long-period lateral steady acceleration, extremely long rails extending in the left and right directions are required. This means that the size of the entire system needs to be large.

SUMMARY OF THE INVENTION

The present invention was made to solve the aforementioned problems; and more particularly, the object of the invention is to provide a lateral steady acceleration simulation system for railway vehicle, which is capable of simulating a situation in which the lateral steady acceleration is applied to a railway vehicle for a long period of time, while having a compact structure.

In order to attain the aforementioned object, there is provided a lateral steady acceleration simulation system for railway vehicle comprising:

a simulated passenger room simulating an interior of a railway vehicle;

a base for supporting the simulated passenger room;

roll application means provided between the base and the simulated passenger room, the roll application means being capable of applying to the simulated passenger room at least rolling movement about a forward-backward axis;

laterally moving means for moving the base in either of the left or right direction; and control means for controlling the roll application means and the laterally moving means; wherein the control means makes control in such a manner that the simulated passenger room is rotated and inclined about the forward-backward axis by means of the roll application means, thereby causing to a person riding on the simulated passenger room a first reproductive acceleration that is a component force, along an inclined plane, of gravitational acceleration, and also in such a manner that the base is subjected to accelerated motion in either of the left or right direction by means of the laterally moving means, thereby causing a second reproductive acceleration to the person riding on the simulated passenger room, the first and second reproductive accelerations both being utilized to simulate lateral steady acceleration on a railway.

According to the simulation system of the invention, the lateral steady acceleration on the railway is not simulated only by utilizing the acceleration bodily sensed by the person riding on the simulated passenger room by means of the accelerated motion of the base integrated with the simulated passenger room. In addition to such acceleration, the acceleration bodily sensed by the person riding on the simulated passenger room by means of the rolling movement (rotation) and inclination of the simulated passenger room is also utilized, thereby simulating the lateral steady acceleration on the railway.

Therefore, according to the simulation system of the invention, even in cases where a railway vehicle is subjected to the lateral steady acceleration for a long period of time, for example, in the case of running through a long-distance curving section of a railroad track, such a long-period lateral steady acceleration can be simulated by utilizing the acceleration bodily sensed by the person riding on the simulated passenger room by means of the inclination of the simulated passenger room as well as the acceleration bodily sensed by him/her by means of the accelerated motion of the simulated passenger room. In this case, it is not necessary that the simulated passenger room should be moved such a long distance in the left or right direction. As a result, the simulation system of the invention is capable of simulating a situation in which a railway vehicle is subjected to the lateral steady acceleration for a long period of time, while having a compact structure.

In the lateral steady acceleration simulation system of the invention, it is preferable that the control means sets angular acceleration or angular velocity, in making the simulated passenger room roll about the forward-backward axis by means of the roll application means, within a range in which the rolling movement is not recognized by human beings. In this manner, in spite of the fact that the simulated passenger room is actually rotated, the person riding thereon is not aware of its rotation, and thus, he/she does not have a strange feeling about the riding quality. The aforementioned range may be experientially determined in advance.

In the lateral steady acceleration simulation system of the invention, it is preferable that the control means compensates for insufficiency of the first reproductive acceleration with the second reproductive acceleration, thereby simulating the lateral steady acceleration on the railway. In other words, in simulating the lateral steady acceleration on the railway, the first reproductive acceleration is mainly utilized, and the second reproductive acceleration is utilized for the purpose of compensation therefor. In this case, the rate of the second reproductive acceleration in the lateral steady acceleration to be simulated becomes smaller and, consequently, the moving distance of the base integrated with the simulated passenger room can be shortened, which results in a further compact structure of the system.

In the lateral steady acceleration simulation system of the invention, it is preferable that the control means adjusts the second reproductive acceleration such that it has negative value, and correspondingly adjusts the first reproductive acceleration so as to stop the motion of the base, if the base is in motion in either of the left or right direction when the second reproductive acceleration has reached zero. At a point of time at which the second reproductive acceleration has reached zero, the lateral steady acceleration is simulated only by utilizing the first reproductive acceleration and, therefore, it would be possible to keep simulating the lateral steady acceleration by maintaining such a state. However, in cases where the base is in motion when the second reproductive acceleration has reached zero, and if such a state is maintained as it is, the base continues to move at a constant velocity, which results in a large moving distance of the base in the left or right direction. Thus, in such a case, the second reproductive acceleration is preferably adjusted to have negative value, and the first reproductive acceleration is preferably adjusted correspondingly as well, thereby stopping the motion of the base. In this manner, the base is not kept moving, and thus, the structure of the system can be made compact.

BRIEF DESCRIPTION OF THE DRAWINGS

FIGS. 3A to 3E are explanatory views showing the motion of the actuators when vibration along each of six axes is applied to a simulated passenger room;

PREFERRED EMBODIMENT OF THE INVENTION

Figure 1:
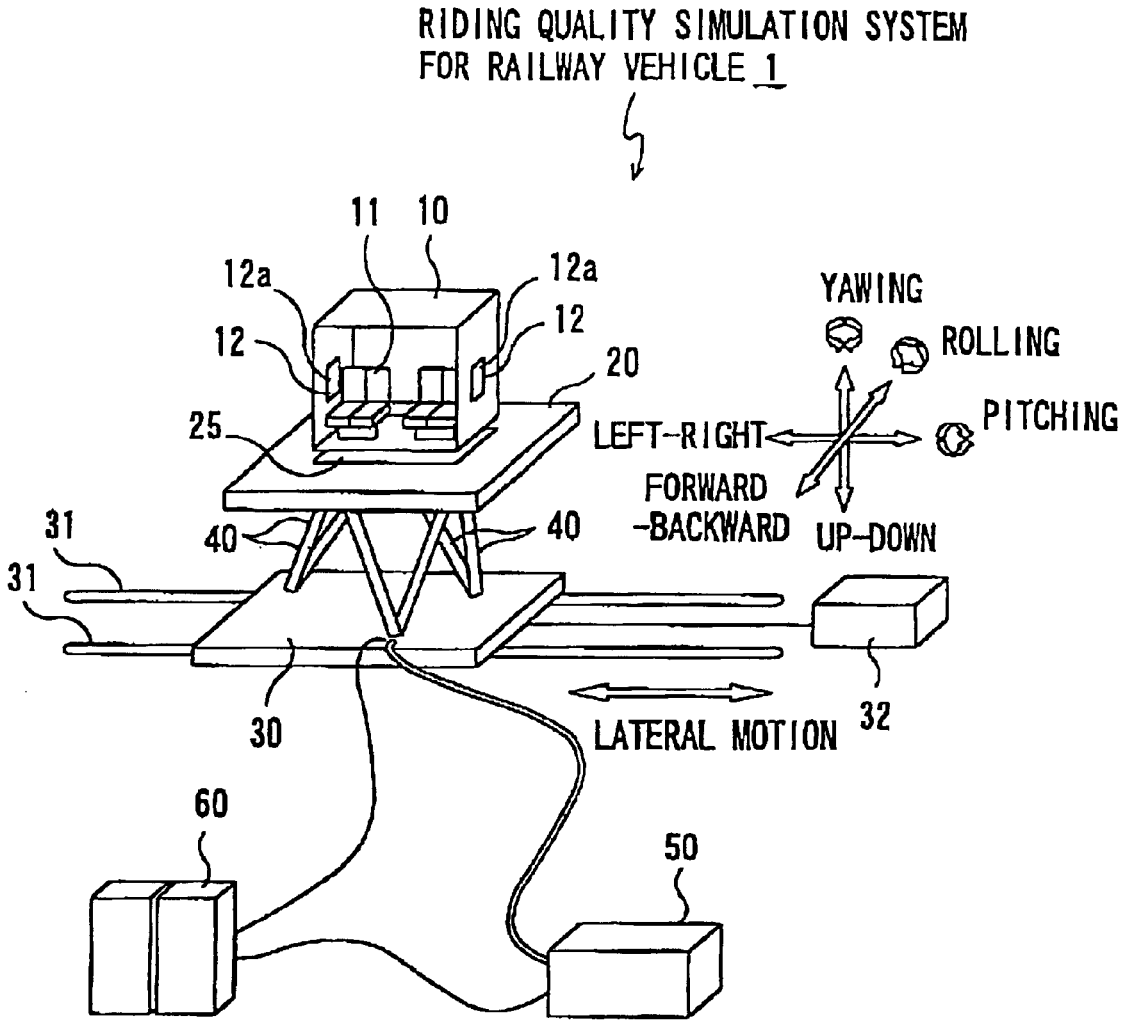
FIG. 1 is a view showing the entire structure of a riding quality simulation system according to an embodiment of the invention.

A preferred embodiment of the invention is hereinafter described with reference to the drawings. FIG. 1 is a view showing the entire structure of a riding quality simulation system according to the embodiment. A riding quality simulation system 1 according to this embodiment is an example of a lateral steady acceleration simulation system of the invention, which comprises a simulated passenger room 10, a passenger room mounting table 20, a base 30, six actuators 40, a drive unit 60, and a control unit 60.

The simulated passenger room 10 is a closed space imitating an interior of a railway vehicle. In the simulated passenger room 10, seats 11, which are the same as those of the railway vehicle, are arranged in the same manner as in the railway vehicle. Peripheral walls and a ceiling are also provided in the same manner as those of the railway vehicle. Each of lateral walls is provided with a simulated window 12, in which an imaging device 12*a* is installed. While a simulated running test is being performed, views seen from an actual railway vehicle during its traveling are projected on the imaging device 12*a*. Furthermore, speakers (not illustrated) are also installed inside the simulated passenger room 10 such that, while the simulated running test is being performed, sounds heard in an actual railway vehicle during its traveling are outputted from the speakers.

The passenger room mounting table 20 is a table on which the simulated passenger room 10 is to be mounted. The simulated passenger room 10 is mounted on the passenger room mounting table 20 via a high-frequency vibration table 25. The high-frequency vibration table 25 is a relatively small device that is capable of reproducing vibration along three axes, i.e., an up-down axis, a left-right axis, and a forward-backward axis, in a high-frequency range of at least 5 to 40 Hz.

The base 30 supports the passenger room mounting table 20 via six actuators 40. The base 30 is movable along two guide rails 31, 31 extending in the lateral direction. More specifically, the base 30 is moved by a laterally moving device 32 (corresponding to laterally moving means of the invention), which is employed, during the simulated running test, to simulate running of a railway vehicle taking a curve.

Figure 2:
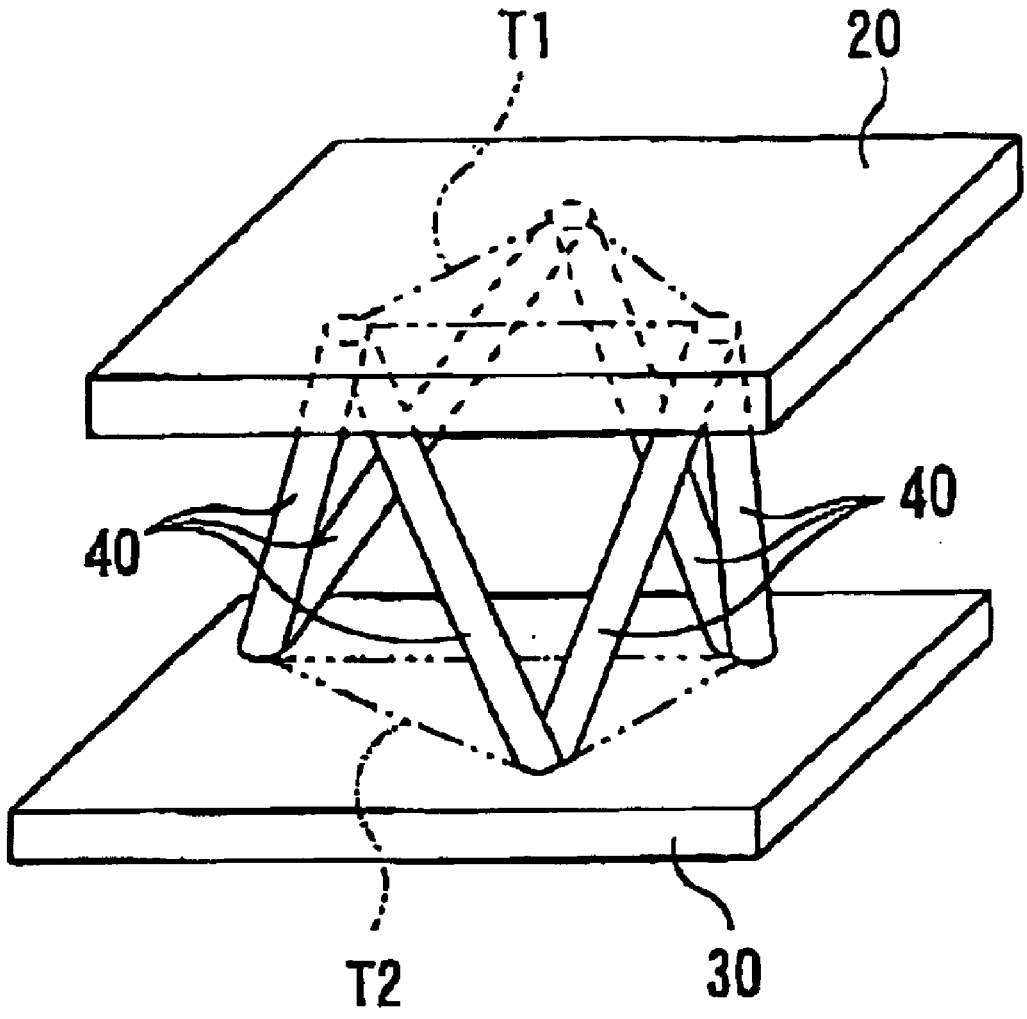
FIG. 2 is an explanatory view showing how to dispose actuators.

The six actuators 40 are, as shown in FIG. 2, respectively arranged along six sides of a virtual octahedron comprising, as its top face, a virtual triangle T1 on the passenger room mounting table 20 and, as its bottom face, a virtual triangle T2 on the base 30, the six sides respectively connecting vertexes of the virtual triangle T1 and those of the virtual triangle T2. Each of the actuators 40 is rotatably attached, at its upper end, to the undersurface of the passenger room mounting table 20 and, at its lower end, to the top face of the base 30. Each actuator 40 is a hydraulic servo actuator (that is, a vibration generation part having a piston with a hydraulic control mechanism) and, as shown in FIG. 3, is composed of a piston rod 41 for its upper part and a cylinder 42 for its lower part The drive unit 50 drives the actuators 40 by supplying each of the actuators 40 with hydraulic pressure generated by a hydraulic pump (not shown).

The control unit 60 (corresponding to control means of the invention) controls the drive unit 50 such that the hydraulic pressure generated by the hydraulic pump of the drive unit 50 is adjusted to provide a pressure and a flow as required by each of the actuators 40, thereby activating each of the actuators 40. In this manner, the simulated passenger room 10 mounted on the passenger room mounting table 20 is subjected to oscillation or vibration in a low-frequency range along six axes, that is, an up-down axis, a left-right axis, a forward-backward axis, a yaw axis (i.e., rotary motion about the up-down axis), a pitch axis (i.e., rotary motion about the forward-backward axis), and a roll axis (i.e., rotary motion about the forward-backward axis). Also, the control unit 60 controls the laterally moving device 32 so as to move the base 30 integrated with the simulated passenger room 10 with an arbitrary acceleration.

Here, a unit for applying oscillation or vibration in a low-frequency range along six axes, including the six actuators 40 and the drive unit 50, is referred to as a six-degree-of-freedom vibration device (corresponding to roll application means of the invention). As such a six-degree-of-freedom vibration device, for example, a Stewart-type six-degree-of-freedom motion, which is conventionally known, may be employed.

Now, the operation of the six-degree-of-freedom vibration device of the riding quality simulation system 1 according to this embodiment is described. FIGS. 3A to 3E are explanatory views showing the motion of the six actuators 40 when vibration along each of six axes is applied to the simulated passenger room. As shown in FIGS. 3A to 3E, the control unit 60 controls the drive unit 50 so as to appropriately adjust the amount of protrusion of the piston rods 41 of the six actuators 40, thereby applying to the passenger room mounting table 20, and thus to the simulated passenger room 10, oscillation or vibration in a low-frequency range along the up-down axis, the left-right axis, the forward-backward axis, the roll axis, the pitch axis, or the yaw axis. Also, the control unit 60 allows a simultaneous application of oscillations or vibrations along a plurality of axes arbitrarily selected among the six axes, by controlling the drive unit 50 accordingly.

Now, in the riding quality simulation system 1 according to this embodiment, the operation for simulating lateral steady acceleration generated when a railway vehicle runs around a curve is described.

Figure 4:
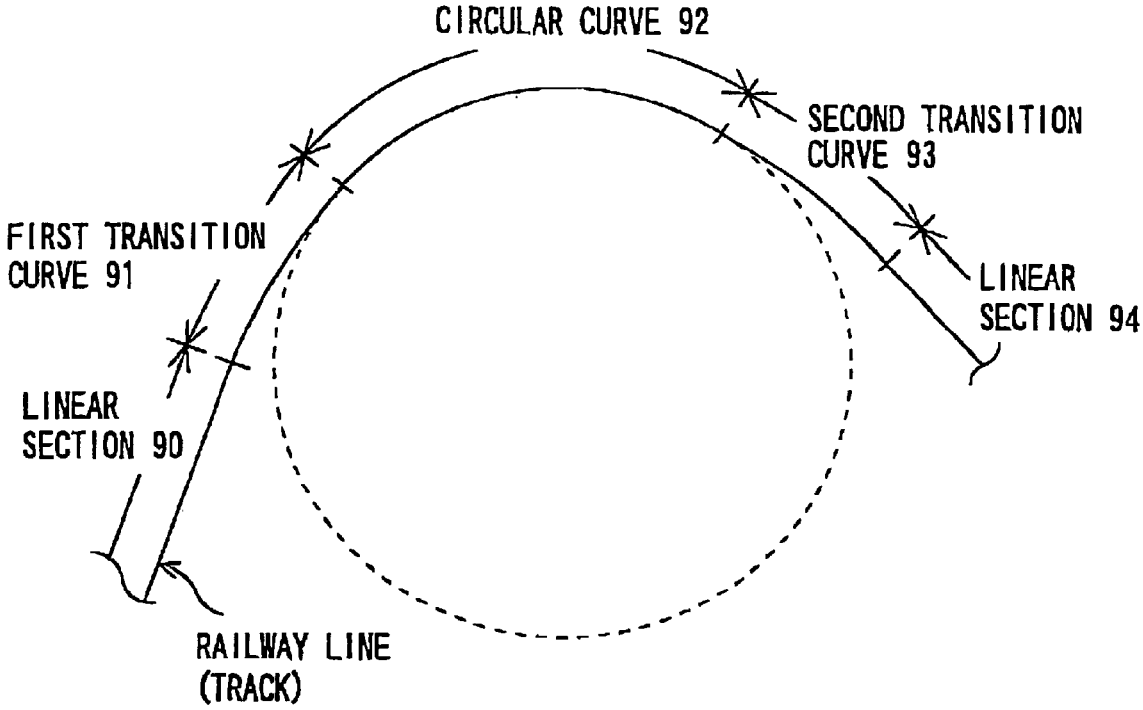
FIG. 4 is an explanatory view showing an example of a curve of a railway line (track)

As shown in FIG. 4, a curve of a railway line (track) comprises a first transition curve 91, a circular curve 92, and a second transition curve 93. The first transition curve 91 is a section of the railway line in which radii of curvature gradually become smaller between a linear section 90 and the circular curve 92 and finally reach a radius of curvature of the circular curve 92. The circular curve 92 is a section of the railway line having a constant radius of curvature. The second transition curve 93 is a section of the railway line in which radii of curvature gradually become larger between the circular curve 92 and a linear section 94, the second transition curve 93 finally turning into a straight line of the linear section 94.

Figure 5:
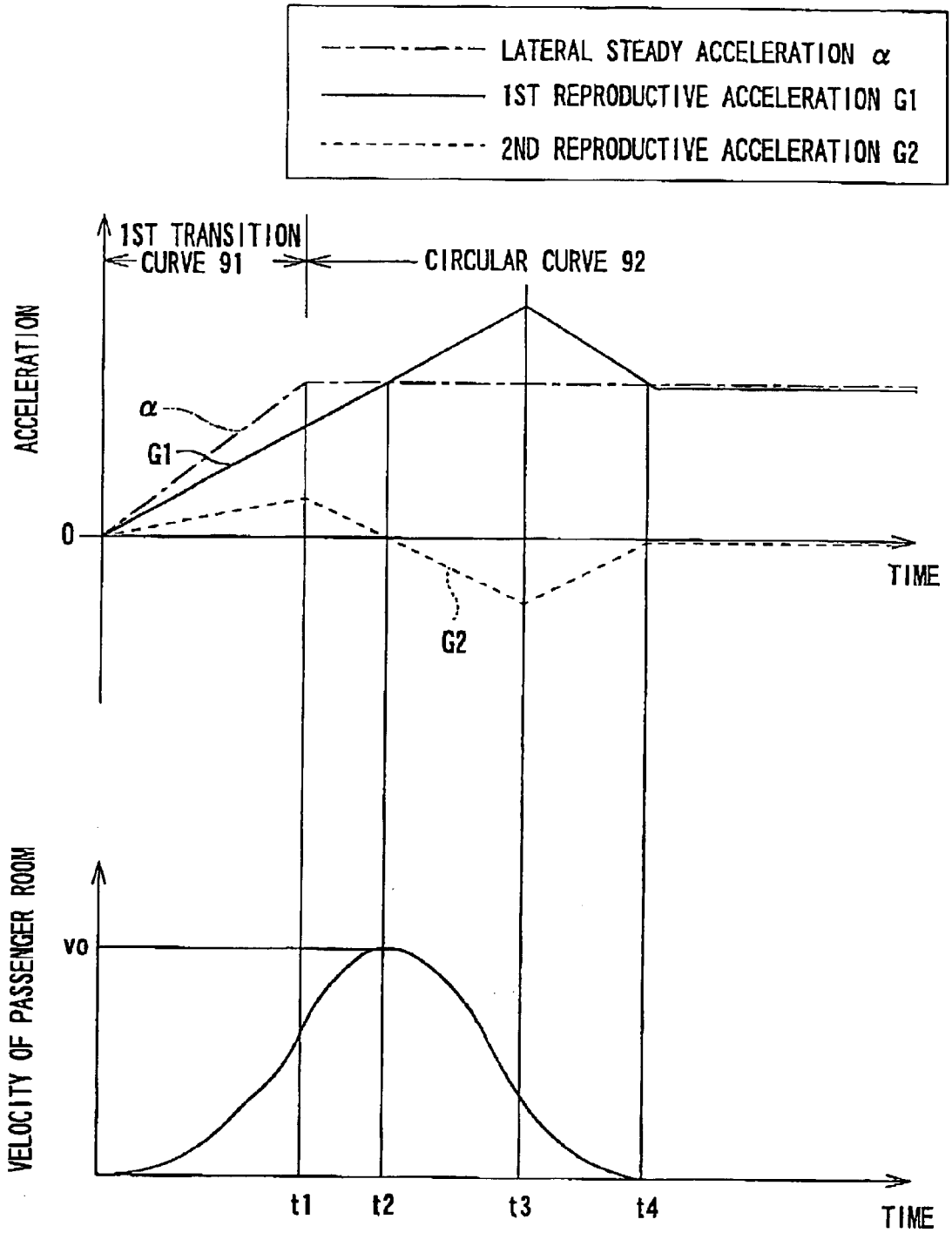
FIG. 5 is a graph showing changes with time in acceleration applied to a passenger and changes with time in velocity of the simulated passenger room, in simulating the traveling of a railway vehicle around a curve.

An example of acceleration generated when a railway vehicle runs around such a curve is shown in FIG. 5. More particularly, shown in an upper part of this FIG. 5 is relationship between time and acceleration to which a person riding on the simulated passenger room 10 is subjected, and shown in a lower part thereof is relationship between time and moving velocity of the simulated passenger room 10. As shown in the upper part of FIG. 5, lateral steady acceleration $\alpha$ (shown by an alternate-long-and-short dashed line) increases at a constant rate in the first transition curve 91 and reaches a fixed value (i.e., constant acceleration) in the circular curve 92.

Figure 6A:
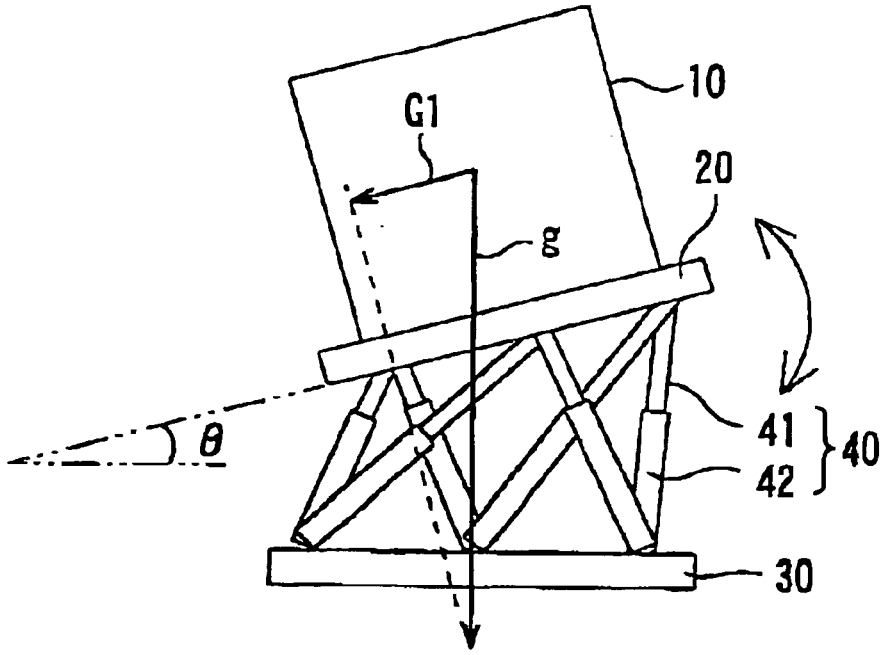
FIGS. 6A and 6B are explanatory views showing first and second reproductive accelerations, respectively.
Figure 6B:
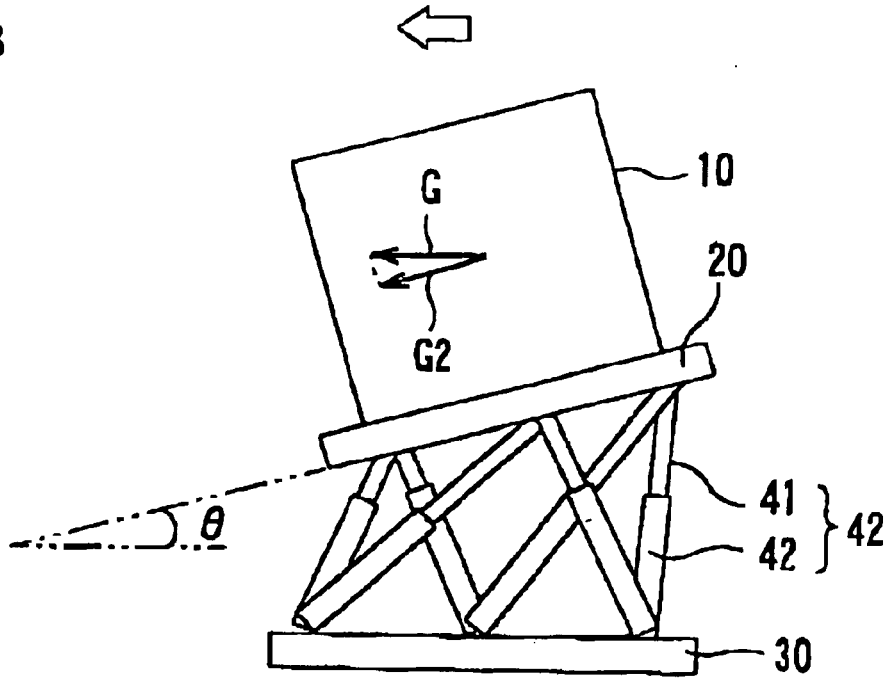

In order to simulate such a lateral steady acceleration pattern as shown in the upper part of FIG. 5, the control unit 60 makes control in such a manner that the simulated passenger room 10 is subjected to roll and the base 30 integrated with the simulated passenger room 10 is subjected to accelerated motion, as shown in FIGS. 6A and 6B.

More specifically, as shown in FIG. 6A, the control unit 60 activates each of the actuators 40 via the drive unit 50, thereby making the simulated passenger room 10 roll (see FIG. 3D). In this manner, the simulated passenger room 10 is gradually inclined, while a component force, along the inclined plane, of gravitational acceleration g, that is, a first reproductive acceleration G1 ($=g\cdot\sin\theta$) is generated depending on an angle of inclination $\theta$. This means that the person riding on the simulated passenger room 10 bodily senses the first reproductive acceleration G1 by the roll. Also, as shown in FIG. 6B, the control unit 60 moves the simulated passenger room 10, by means of the laterally moving device 32, in either of the left or right direction with acceleration G. Accordingly, the person riding on the simulated passenger room 10 bodily senses a second reproductive acceleration G2, which is a component force, along the inclined plane, of the acceleration G of the simulated passenger room ($=G\cdot\cos\theta$). As a result, the person riding on the simulated passenger room 10 bodily senses a combination of the first and second reproductive accelerations G1 and G2 as lateral steady acceleration on a railway.

Now, the procedure for simulating the lateral steady acceleration pattern as shown in the upper part of FIG. 5 is described in detail. First of all, a range of angular acceleration and angular velocity within which rolling movement is not recognized by a person riding on the simulated passenger room 10 is experientially determined in advance (this range hereinafter referred to as an insensible range). In the first transition curve 91, the simulated passenger room 10 is subjected to rolling movement within the insensible range. In this manner, as the simulated passenger room 10 is inclined by the rolling movement, its angle of inclination $\theta$ is increased, and the first reproductive acceleration G1 is increased as well. In this respect, the first reproductive acceleration G1 is controlled to increase at a fixed rate. Then, insufficiency of the first reproductive acceleration G1 relative to the lateral steady acceleration $\alpha$ is compensated for with the second reproductive acceleration G2, thereby simulating the lateral steady acceleration $\alpha$ ($=G1+G2$). Here, the second reproductive acceleration G2 is also increased at a fixed rate.

Subsequently, the first reproductive acceleration G1 is still increased at the fixed rate for a while after reaching a point of time t1, at which switching is made to the circular curve 92. On the contrary, the second reproductive acceleration G2 is now decreased at a fixed rate, since the insufficiency of the first reproductive acceleration G1 relative to the lateral steady acceleration $\alpha$ is gradually reduced.

Then, at a point of time t2, at which the first reproductive acceleration G1 becomes equal to the lateral steady acceleration $\alpha$, the second reproductive acceleration G2 becomes zero. However, at the point of time t2, the base 30 integrated with the simulated passenger room 10 is still moving at a velocity v0 (see the lower part of FIG. 5). Accordingly, if this state were maintained as it were, lack of length of the guide rails 31, 31 would be raised due to the continuing motion of the base 30 integrated with the simulated passenger room 10, although the lateral steady acceleration $\alpha$ could be simulated only by the first reproductive acceleration G1.

Therefore, after passing the point of time t2, the second reproductive acceleration G2 continues to be decreased at the fixed rate to reach negative value, such that the velocity of the simulated passenger room 10 is lowered. On the other hand, the first reproductive acceleration G1 continues to be increased at the fixed rate so as to be equal, in combination with the second reproductive acceleration G2, to the lateral steady acceleration $\alpha$.

Further subsequently, the second reproductive acceleration G2 still has negative value after passing a point of time t3. However, the absolute value thereof is decreased at a fixed rate, and thus, the moving velocity of the base 30 integrated with the simulated passenger room 10 is finally made zero at a point of time t4. Between the points of time t3 and t4, the first reproductive acceleration G1 is decreased at a fixed rate so as to be equal, in combination with the second reproductive acceleration G2, to the lateral steady acceleration $\alpha$.

Then, after passing the point of time t4, the second reproductive acceleration G2 is kept zero, and the lateral steady acceleration $\alpha$ is simulated only by the first reproductive acceleration G1. In other words, after the point of time t4, the lateral steady acceleration $\alpha$ is simulated only by means of the angle of inclination $\theta$ of the simulated passenger room 10, with the base 30 integrated with the simulated passenger room 10 stopping.

On the contrary, in order to simulate the lateral steady acceleration applied to the railway vehicle during running from the circular curve to the linear section passing through the second transition curve, the reversed control may be carried out.

As described in detail above, by adopting the riding quality simulation system 1 according to the embodiment, lateral steady acceleration applied to a railway vehicle for a long period of time, for example, in cases where the railway vehicle runs through a long-distance curving section, can be simulated. More particularly, such lateral steady acceleration is simulated by utilizing the first reproductive acceleration G1 that is bodily sensed by a person riding on the simulated passenger room 10 by means of the inclination of the simulated passenger room 10, in addition to the second reproductive acceleration G2 that is bodily sensed by the person riding on the simulated passenger room 10 by means of the accelerated motion of the simulated passenger room 10. Consequently, it is not necessary that the simulated passenger room 10 should be shifted such a long distance in the left or right direction. Accordingly, a situation in which a railway vehicle is subjected to lateral steady acceleration for a long period of time can be simulated within a compact structure of the system.

Also, the angular acceleration or angular velocity in making the simulated passenger room 10 roll is set within an insensible range and, accordingly, the person riding on the simulated passenger room 10 does not become aware of the rolling movement. Therefore, he/she does not have a strange feeling about the riding quality. Especially, the simulated passenger room 10 is a closed space and the person riding thereon can not see the outside, which makes it more difficult for him/her to notice the simulated passenger room 10 rotating. As a result, the person riding on the simulated passenger room 10 would never feel odd while riding thereon.

Furthermore, in simulation of the lateral steady acceleration on the railway, the first reproductive acceleration G1 is mainly utilized, while the second reproductive acceleration G2 is utilized for the purpose of compensation therefor. Consequently, the rate of the second reproductive acceleration G2 in the lateral steady acceleration to be simulated becomes smaller, and a moving distance of the simulated passenger room 10 can thus be shortened, which results in a further compact structure of the system.

Further in addition, in cases where the base 30 is still in motion at the point of time t2, at which the second reproductive acceleration G2 has reached zero, the second reproductive acceleration G2 is adjusted to have negative value such that the motion of the base 30 is stopped thereafter. At the same time, the first reproductive acceleration G1 is correspondingly adjusted and, therefore, the base 30 is not kept moving, which also results in a compact structure of the system.

The present invention is, of course, not restricted to the above described embodiment, and may be practiced or embodied in still other ways within the technical scope of the invention.

For example, in the above described embodiment, the six actuators 40 are provided as the roll application means for making the simulated passenger room 10 roll. However, the roll application means is not restricted to such actuators 40 and may be any other device that can make the simulated passenger room 10 roll. More particularly, the four-axis simulation system as mentioned in the description of the "Background Art" may be employed.

Also, in the above described embodiment, centrifugal force generated at the time of rolling of the simulated passenger room 10 is not taken into consideration; however, the lateral steady acceleration may be simulated in view of such centrifugal force.

Furthermore, in the above described embodiment, the base 30 is moved by means of the laterally moving device 32; however, the base 30 may be designed to be movable by itself in the left or right direction.

Further in addition, in the above described embodiment, a relatively simple pattern is given as an example of a lateral steady acceleration pattern, as shown in FIG. 5. However, the lateral steady acceleration simulation system of the invention is capable of simulating not only lateral steady acceleration that is linearly changed as in the case of FIG. 5, but also lateral steady acceleration that is more complicatedly changed with a curve.

INDUSTRIAL APPLICABILITY

As mentioned above, by adopting a lateral steady acceleration simulation system of the invention, it is possible to simulate a situation in which a railway vehicle is subjected to the lateral steady acceleration for a long period of time, while having a compact structure.

What is claimed is:

1. A lateral steady acceleration simulation system for railway vehicle, comprising:

a simulated passenger room simulating an interior of a railway vehicle;

a base for supporting the simulated passenger room;

a roll application mechanism provided between the base and the simulated passenger room and capable of applying to the simulated passenger room at least a rolling movement about a forward-backward axis;

a laterally moving mechanism for moving the base in either of a left or a right direction and capable of applying a corresponding lateral acceleration to the simulated passenger room; and a control mechanism for controlling the roll application mechanism and the laterally moving mechanism, so that the simulated passenger room is rotated and inclined about the forward-backward axis by the roll application mechanism, thereby imposing on a person riding on the simulated passenger room a first reproductive acceleration that is a component force of gravitational acceleration along an inclined plane, and the base is subjected to accelerated motion in one of the left direction and the right direction by the laterally moving mechanism, thereby imposing on the person riding on the simulated passenger room a second reproductive acceleration by lateral acceleration of the base, wherein the first reproductive acceleration and the second reproductive acceleration together simulate a lateral acceleration of a railway vehicle on a curve of a railway, and wherein the control mechanism compensates for an insufficiency of the first reproductive acceleration with the second reproductive acceleration.

2. The lateral steady acceleration simulation system for railway vehicle of claim 1, wherein:

the control mechanism controls the roll application mechanism and the laterally moving mechanism to generate the second reproductive acceleration with a gradient less than a gradient of the first reproductive acceleration such that the second reproductive acceleration compensates for the insufficiency of the first reproductive acceleration in at least an initial stage of the simulation of a lateral acceleration of a railway vehicle on a curve of a railway.

3. The lateral steady acceleration simulation system for railway vehicle of claim 1, wherein:

the control mechanism controls the roll application mechanism and the laterally moving mechanism to generate the second reproductive acceleration with a gradient less than a gradient of the first reproductive acceleration such that the second reproductive acceleration compensates for the insufficiency of the first reproductive acceleration in the simulation of a lateral acceleration of a railway vehicle on a curve of a railway.

4. The lateral steady acceleration simulation system for railway vehicle of claim 1, wherein:

the control mechanism controls an angular acceleration and an angular velocity of the rotation of the simulated passenger room about the forward-backward axis by the roll application mechanism to be within a range in which the rolling movement is not recognized by human beings.

5. The lateral steady acceleration simulation system for railway vehicle of claim 1, wherein:

when the base is in motion in one of the left direction and the right direction and the second reproductive acceleration has reached zero, the control mechanism adjusts the second reproductive acceleration to have a negative value so as to stop motion of the base and correspondingly adjusts the first reproductive acceleration.

6. A lateral steady acceleration simulation system for railway vehicle comprising:

a simulated passenger room simulating an interior of a railway vehicle;

a base for supporting the simulated passenger room;

a roll application mechanism provided between the base and the simulated passenger room, the roll application mechanism being capable of applying to the simulated passenger room at least a rolling movement about a forward-backward axis;

a laterally moving mechanism for moving the base in either of a left or a right direction; and a control mechanism for controlling the roll application mechanism and the laterally moving mechanism; wherein the control mechanism makes control in such a manner that the simulated passenger room is rotated and inclined about the forward-backward axis by mechanism of the roll application mechanism, thereby causing to a person riding on the simulated passenger room a first reproductive acceleration that is a component force, along an inclined plane, of gravitational acceleration, and also in such a manner that the base is subjected to accelerated motion in either of the left or right direction by way of the laterally moving mechanism, thereby causing a second reproductive acceleration to the person riding on the simulated passenger room, the first and second reproductive accelerations both being utilized to simulate lateral steady acceleration on a railway, and the control mechanism controls the roll application mechanism and the laterally moving mechanism to generate the second reproductive acceleration whose absolute figure is less than that of the first reproductive acceleration such that the second reproductive acceleration compensates for the insufficiency of the first reproductive acceleration in the simulation of a lateral acceleration of the railway vehicle on a curve of a railway.

7. A lateral steady acceleration simulation system for railway vehicle comprising:

a simulated passenger room simulating an interior of a railway vehicle;

a base for supporting the simulated passenger room;

a roll application mechanism provided between the base and the simulated passenger room, the roll application mechanism being capable of applying to the simulated passenger room at least a rolling movement about a forward-backward axis;

a laterally moving mechanism for moving the base in either of a left or a right direction; and a control mechanism for controlling the roll application mechanism and the laterally moving mechanism; wherein the control mechanism makes control in such a manner that the simulated passenger room is rotated and inclined about the forward-backward axis by mechanism of the roll application mechanism, thereby causing to a person riding on the simulated passenger room a first reproductive acceleration that is a component force, along an inclined plane, of gravitational acceleration, and also in such a manner that the base is subjected to accelerated motion in either of the left or right direction by way of the laterally moving mechanism, thereby causing a second reproductive acceleration to the person riding on the simulated passenger room, the first and second reproductive accelerations both being utilized to simulate lateral steady acceleration on a railway, the control mechanism compensates for an insufficiency of the first reproductive acceleration with the second reproductive mechanism, and the control mechanism controls at least one of an angular acceleration and an angular velocity of the rotation of the simulated passenger room about the forward-backward axis by the roll application mechanism to be within a range in which the rolling movement is not recognized by human beings.

* * * * *